US007165332B2

(12) United States Patent
McGrail et al.

(10) Patent No.: US 7,165,332 B2
(45) Date of Patent: Jan. 23, 2007

(54) METHOD AND APPARATUS FOR POSITIONING A BILLIARD GAME RACK

(76) Inventors: Peter McGrail, 394 School St., East Hartford, CT (US) 06108; Ken Couture, 6 Cambridge Dr., Glastonbury, CT (US) 06033

( * ) Notice: Subject to any disclaimer, the term of this patent is extended or adjusted under 35 U.S.C. 154(b) by 0 days.

(21) Appl. No.: 10/925,741

(22) Filed: Aug. 24, 2004

(65) Prior Publication Data

US 2006/0042105 A1 Mar. 2, 2006

(51) Int. Cl.
*A63D 15/00* (2006.01)
*G01C 15/00* (2006.01)

(52) U.S. Cl. ..... 33/286; 33/DIG. 21; 33/227; 473/40; 473/2

(58) Field of Classification Search ..... 33/286, 33/DIG. 21, 613, 645, 227; 473/21, 26, 473/40, 41, 2
See application file for complete search history.

(56) References Cited

U.S. PATENT DOCUMENTS 1,127,318 A * 2/1915 Thomas ..... 473/1
2,414,983 A * 1/1947 Smith ..... 473/40
4,183,523 A * 1/1980 Hecht ..... 473/40
4,882,676 A * 11/1989 Van De Kop et al. ..... 473/2
5,554,075 A * 9/1996 Glazer ..... 473/2
5,735,750 A * 4/1998 Silverman ..... 473/40
5,800,273 A * 9/1998 Potocki ..... 473/1
RE36,257 E * 7/1999 Thomson ..... 33/1 G
6,371,860 B1 4/2002 Anderson
6,609,307 B1 8/2003 Haynes et al.
6,629,897 B1 * 10/2003 Belknap ..... 473/40
6,769,992 B1 * 8/2004 Domulevicz et al. ..... 473/2
7,063,620 B1 * 6/2006 Nearhood ..... 473/2
2002/0032068 A1 3/2002 Belknap
2004/0132535 A1 * 7/2004 Sumko ..... 473/2
2005/0037851 A1 * 2/2005 Evers ..... 473/2

* cited by examiner

*Primary Examiner*—Diego Gutierrez
*Assistant Examiner*—Amy R. Cohen
(74) *Attorney, Agent, or Firm*—Robert S. Smith

(57) ABSTRACT

Apparatus for cooperation with an associated billiard table which includes first and second laser apparatus for producing respective first and second laser spots, a rack for positioning a plurality of balls confined within said rack. The rack has first and second indicia thereon and a support carrying said first and second laser apparatus in spaced relationship. The support may be dimensioned and configured to permit adjustment thereof to align respectively said first and second laser spots with respectively said first and second indicia when said rack is in a predetermined location on the associated billiard table.

20 Claims, 2 Drawing Sheets

METHOD AND APPARATUS FOR POSITIONING A BILLIARD GAME RACK

BACKGROUND OF THE INVENTION

The invention relates to pocket billiards apparatus and methods and particularly to apparatus and methods for positioning the ball rack used to position the balls to start a new game. The term "billiards" as used herein will be understood to refer to the games of billiards, pool, and snooker. More particularly, the rack positions all of the balls, except the cue ball, in an array appropriate for the specific game. For example, the array may be triangular although other games may utilized in array having another shape. For those games utilizing a triangular array, the rack must be positioned so that the ball at the apex of the triangular array nearest to the center of the table is directly on the foot spot. When the balls are racked, all the balls in the array must be lined up behind the apex ball (when present) and pressed together so that adjacent balls are in contact with each other. The positioning of the balls in the racking process affects the break which affects the subsequent play of the game. The reliance on positioning the apex ball on the foot spot has inherent weaknesses. For example, when the apex ball is on top of the foot spot it is not possible to see the foot spot. U.S. Pat. No. 6,609,307, issued on Aug. 26, 2003 to Haynes et al., includes a laser apparatus utilizing a single laser beam for positioning the apex ball. This patent is incorporated herein by reference.

While the apparatus described therein provides some advantage over the mere reliance on a foot spot on the upper face of the table, it still does not ensure the precise placement of all of the other balls within the rack. More specifically, even the apparatus in this patent does not preclude a player from improper alignment of the rack. It is clear that, when using a triangular rack, the side of the rack opposite to the apex ball should ideally be perpendicular to an imaginary line that axially bisects the elongated billiard table. Stated another way, if the rack is optimally positioned, an imaginary line that axially bisects the elongated billiard table will also bisect the rack when the rack is properly positioned. Just as very subtle angular variations produced radical changes in the result produced by given a shot, it is clear that subtle angular variations can produce radical changes when the break shot is made. The placement of a laser apparatus to produce a single spot on the table corresponding to the apex ball is complicated by the very common placement of elongated lighting apparatus over the table and particularly over the portion of the table that includes the conventional foot spot.

United States Patent Application Publication US 2002/0032068 A1, published on Mar. 14, 2002, identifies the problem of the rack not being square with the table. The asserted solution therein utilizes a plurality of light sources including lasers and light emitting diodes or other sources of light together with a plurality of beam splitting elements positioned on the rack and a plurality of photo detectors. At least in some cases the apparatus requires modification of the table as well as the rack. The multiplicity of elements required for alignment will inherently be dependent on each of these multiple elements not being bumped in a manner that would change the alignment. In addition, the location of these elements on the upper face of the table and on the rack increases the probability of these elements be bumped.

U.S. Pat. No. 6,371,860 utilizes laser apparatus to illustrate the position of a foul line.

SUMMARY OF THE INVENTION

It is an object to the present invention to provide a method and apparatus that will facilitate simultaneous precise placement of the apex ball on the foot spot as well as the precise placement of the entire array of balls in the rack.

A further object of the present invention is to provide a method and apparatus that will function despite the conventional placement of lighting apparatus directly over the foot spot.

Another object of the invention is to provide an apparatus and method that can be manufactured inexpensively and may be utilized easily.

A still further object of the invention is to provide apparatus that will primarily be located away from the billiard table and rack so that it will not be vulnerable to bumping that would compromise the accuracy of the apparatus.

Still another object of the invention is to provide an apparatus and method that can easily be adjusted.

Yet another object of the invention is to provide apparatus that can be easily retrofitted to existing billiard table and light systems.

It has now been found that these and other objects of the invention may be attained in an apparatus for cooperation with an associated billiard table which includes first and second laser apparatus for producing respective first and second laser spots and a rack for positioning a plurality of balls confined within said rack. The rack has first and second indicia thereon and a support carrying said first and second laser apparatus in spaced relationship. The support is dimensioned and configured to permit adjustment thereof to align respectively said first and second laser spots with respectively said first and second indicia when the rack is in a predetermined location on the associated billiard table.

Some forms of the apparatus include at least one ball and socket joint for supporting at least one of the first and second laser apparatus. Other forms of the apparatus include a support that includes first and second socket joints for respectively supporting said first and second laser apparatus. The rack may be triangular and the first and second indicia may be positioned on first and second sides of the rack and said first and second sides of the rack may be adjacent. In some forms of the invention first and second sides of the rack intersect in a first apex that is proximate to the apex ball when the balls are racked. The first and second indicia may be disposed at equal distances from the first apex.

Various forms of the apparatus in accordance with the present invention may have the first and second laser apparatus spaced apart sufficiently to avoid obstructions over the associated billiard table. For example, the first and second laser apparatus are spaced apart sufficiently to straddle associated lighting apparatus above the billiard table.

Another form of the invention includes the method for positioning a rack on an associated billiard table which includes providing a rack for securing a plurality of balls in a predefined array, providing first and second indicia on said rack, providing first and second laser apparatus for producing respective first and second laser spots, providing adjustable structure for mounting the first and second laser apparatus, and adjusting the first and second laser apparatus to position the first and second laser spots with respect to an associated billiard table that will align with the first and second indicia on said rack when the rack is in a predetermined position on the associated billiard table.

Various forms of the method include the step of providing adjustable structure that includes providing at least one ball and socket joint. Other forms include the step of providing a rack includes providing a rack, that may be triangular, and has first and second indicia on first and second sides of the rack and said first and second sides of said rack are adjacent. The method may include a step of providing a rack that has first and second sides of the rack that intersect in a first apex that is proximate to the apex ball when balls are racked within the rack. The method may include the step of losses this him in providing a rack that includes providing a rack that has the first and second indicia disposed at equal distances from the first apex.

Other forms of the invention include the apparatus for playing billiards which includes a billiard table having a top and a playing surface on the top thereof, first and second laser apparatus for producing respective first and second laser spots, a rack for positioning a plurality of balls confined within said rack on the playing surface, the rack having first and second indicia thereon, a support carrying said first and second laser apparatus in spaced relationship, the support is dimensioned and configured to permit adjustment thereof to align respectively the first and second laser spots with respectively the first and second indicia when said rack is in a predetermined location on the playing surface.

The apparatus may include a support that includes at least one ball and socket joint for supporting at least one of the first and second laser apparatus. Other forms may include first and second socket joints for respectively supporting the first and second laser apparatus. The rack may be triangular and the first and second indicia may be on first and second sides of said rack and said first and second sides of said rack may be adjacent. The first and second sides of said rack may intersect in a first apex that is proximate to the apex ball when the balls are racked. The first and second indicia may be disposed at equal distances from the first apex. The first and second laser apparatus may be spaced apart sufficiently to straddle associated lighting apparatus above the billiard table.

BRIEF DESCRIPTION OF THE DRAWINGS

The invention will be better understood by reference to the accompanying drawing in which.

DESCRIPTION OF THE PREFERRED EMBODIMENTS

Figure 1:
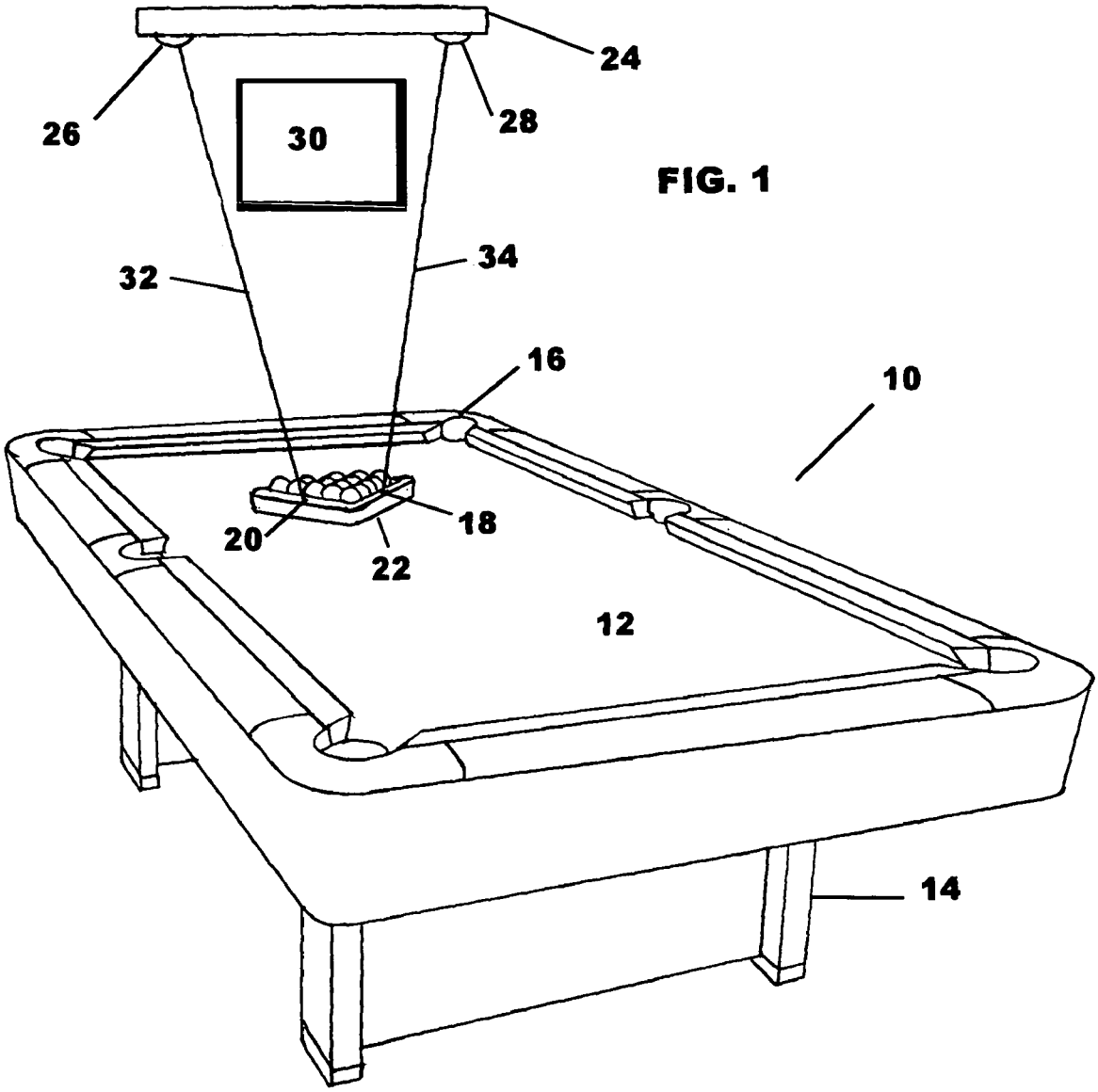
FIG. 1 is a partially diagrammatic of a billiard table in the apparatus in accordance with one form of the present invention.

Referring now to FIG. 1 there is shown one form of the apparatus in accordance with the present invention. The apparatus 10 includes a conventional billiard table 12 having a base 14. The table 12 has an elongated rectangular shape in accordance with the customary design. Pockets 16 are disposed at each corner and at the midpoints of the longer sides thereof. The balls other than the cue ball are racked in a rack 22 having indicia 18, 20 disposed on the upper face thereof. In the preferred embodiment the indicia or spots 18, 20 are disposed symmetrically. Thus, the respective distances between each indicia 18, 20 and the apex of the rack 22, adjacent to the apex ball, are equal.

Illustrated diagrammatically is the overhead elongated lighting apparatus 30. This apparatus typically extends over a substantial axial part of the table 12 to ensure that the players have adequate illumination. It is the lighting apparatus 30 that is an obstacle to retrofitting existing billiard tables with apparatus that utilizes only a single laser beam to locate the rack.

The apparatus in accordance with present invention includes a housing 24 in which two lasers 26, 28 are mounted. These lasers emit respective beams 32, 34 which are positioned to produce respective spots on the respective indicia 20, 18 when the rack is precisely positioned in a manner that is square with the table and the apex ball is directly over the foot spot.

Figure 2:
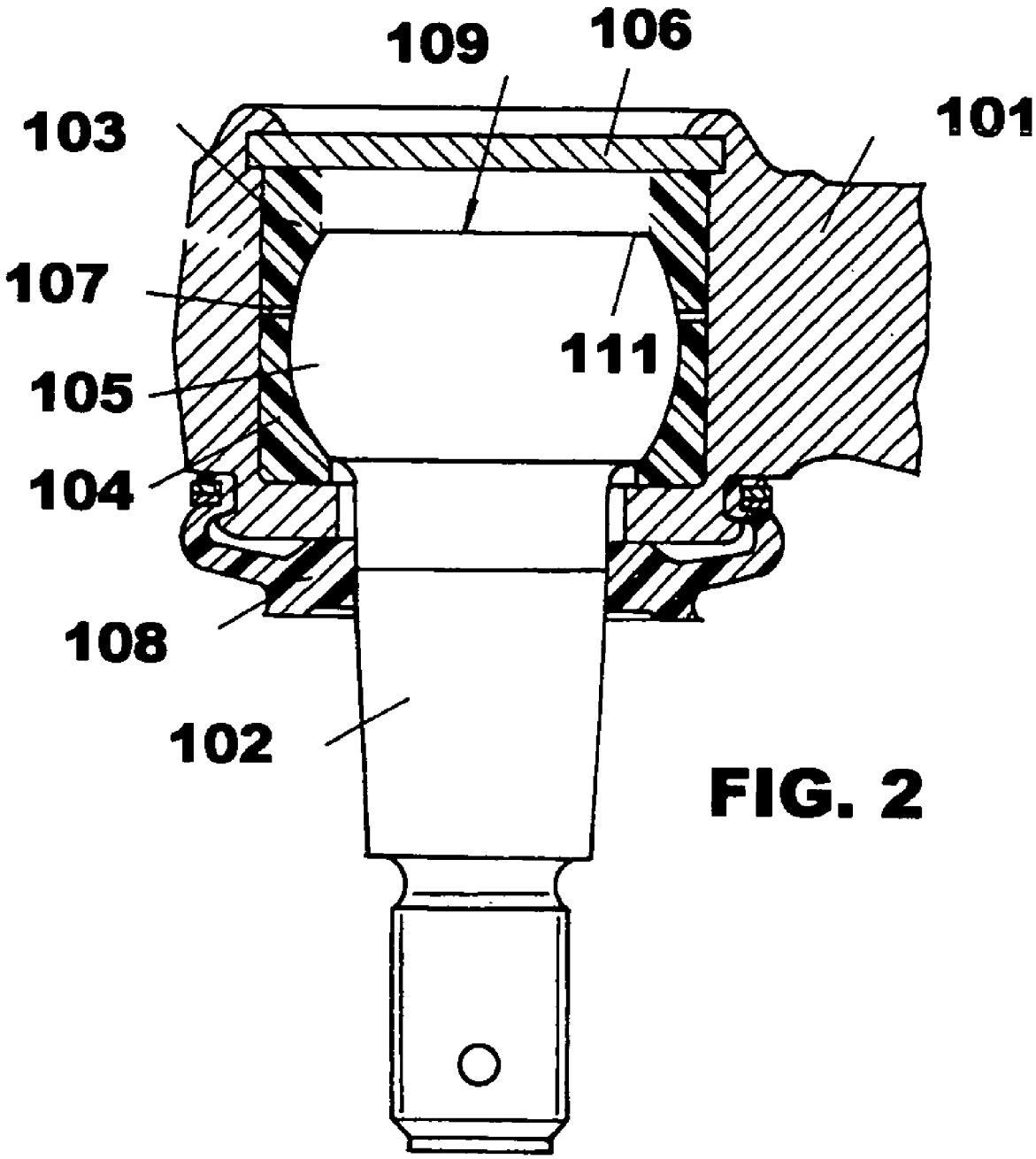
FIG. 2 is a partially diagrammatic view of a ball and socket mounting for a laser apparatus.

In the preferred embodiment the lasers 26,28 are respectively mounted by ball and socket apparatus such as that illustrated in FIG. 2. Other embodiments may use a more simplified structure. The illustrated ball and socket construction includes a casing 101 having a hollowed end portion into which a ball head portion 105 of a ball stud 102 extends. A socket is defined by the elements 103,104 having spherical section face surfaces and limited elasticity engaging the ball head portion 105. The gap between the elements 103, 104 may be filled with a lubricant 107. The ball and socket assembly may further include a cover 106 and a retainer 108. In some embodiments the ball head portion 105 may have a flat upper surface 109. The intersection of the flat upper surface 109 and a spherical section face surface is indicated by the reference numeral 111. In other embodiments the ball head socket may have a spherical upper surface.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described: preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. Apparatus for cooperation with an associated billiard table which comprises:

first and second laser apparatus for producing respective first and second laser beams;

a rack for positioning a plurality of balls confined within said rack, said rack having a first surface that is the uppermost part of said rack and substantially horizontal in normal use of said rack to position a plurality of balls, said rack having first and second indicia on said first surface;

a support carrying said first and second laser apparatus in spaced relationship, said support being dimensioned and configured to permit adjustment thereof to align respectively said first and second laser beams with respectively said first and second indicia when said rack is in a predetermined location on the associated billiard table, said first and second laser beams being substantially perpendicular to said first surface when aligned with said first and second indicia.

2. The apparatus as described in claim 1 wherein said support includes at least one ball and socket joint for supporting at least one of said first and second laser apparatus.

3. The apparatus as described in claim 1 wherein said support includes first and second socket joints for respectively supporting said first and second laser apparatus.

4. The apparatus as described in claim 1 wherein said rack is triangular and said first and second indicia are on first and second sides of said rack and said first and second sides of said rack are adjacent.

5. The apparatus as described in claim 4 wherein first and second sides of said rack intersect in a first apex that is proximate to the apex ball when the balls are racked.

6. The apparatus as described in claim 5 wherein said first and second indicia are disposed at equal distances from said first apex.

7. The apparatus as described in claim 1 wherein said first and second laser apparatus are spaced apart sufficiently to avoid obstructions over the associated billiard table.

8. The apparatus as described in claim 1 wherein said first and second laser apparatus produce laser beams that are substantially perpendicular to said first surface when aligned with said first and second indicia.

9. A method for positioning a rack on an associated billiard table which comprises:

providing a rack for securing a plurality of balls in a predefined array that has an uppermost surface in normal use;

providing first and second indicia on the uppermost surface of the rack;

providing first and second laser apparatus for producing respective first and second laser beams;

providing adjustable structure for mounting the first and second laser apparatus; and adjusting said first and second laser apparatus to position the first and second laser beams in substantially perpendicular relationship to the uppermost surface and intesecting the first and second indicia on the rack when the rack is in a predetermined position on the associated billiard table.

10. The method as described in claim 9 wherein the step of providing adjustable structure includes providing at least one ball and socket joint.

11. The method as described in claim 9 wherein the step of providing a rack includes providing a rack that is triangular and has first and second indicia on first and second sides of the rack and said first and second sides of the rack are adjacent.

12. The method as described in claim 9 wherein said step of providing a rack includes providing a rack that has first and second sides of the rack that intersect in a first apex that is proximate to the apex ball when balls are racked within the rack.

13. The method as described in claim 9 wherein said step of providing a rack includes providing a rack that has the first and second indicia disposed at equal distances from a first apex.

14. Apparatus for playing billiards which comprises:

a billiard table having a top and a playing surface on the top thereof;

first and second laser apparatus for producing respective first and second laser beams;

a rack for positioning a plurality of balls confined within said rack on said playing surface, said rack having a surface that is uppermost in normal use that has first and second indicia thereon;

a support carrying said first and second laser apparatus in spaced relationship, said support being dimensioned and configured to permit adjustment thereof to align respectively said first and second laser beams with respectively said first and second indicia when said rack is in a predetermined location on the playing surface, said first and second laser beams being substantially perpendicular to said first surface when aligned with said first and second indicia.

15. The apparatus as described in claim 14 wherein said support includes at least one ball and socket joint for supporting at least one of said first and second laser apparatus.

16. The apparatus as described in claim 15 wherein said support includes first and second socket joints for respectively supporting said first and second laser apparatus.

17. The apparatus as described in claim 15 wherein said rack is triangular and said first and second indicia are on first and second sides of said rack and said first and second sides of said rack are adjacent.

18. The apparatus as described in claim 17 wherein first and second sides of said rack intersect in a first apex that is proximate to the apex ball when the balls are racked.

19. The apparatus as described in claim 18 wherein said first and second indicia are disposed at equal distances from said first apex.

20. The apparatus as described in claim 14 wherein said first and second laser apparatus are spaced apart sufficiently to straddle associated lighting apparatus above the billiard table.

* * * * *